US005113875A

United States Patent [19]

Bennett

[11] Patent Number: 5,113,875

[45] Date of Patent: May 19, 1992

[54] INFLATABLE LEG-SUPPORTING BOLSTER

[76] Inventor: Trevor S. Bennett, Suite 104 - 3373 Capilano Road, North Vancouver, British Columbia, Canada, V7R 4W7

[21] Appl. No.: 766,666

[22] Filed: Sep. 24, 1991

[51] Int. Cl.[5] ..... A61G 15/10

[52] U.S. Cl. ..... 128/845; 128/DIG. 20; 5/455; 5/648

[58] Field of Search ..... 128/33, 68, 80 R, 845, 128/882, DIG. 20; 297/423, 438, 439, DIG. 8; 5/431, 436, 441, 443

[56] References Cited

U.S. PATENT DOCUMENTS

| | | | |
|---|---|---|---|
| D. 47,140 | 3/1915 | Newkirk . | |
| D. 90,747 | 9/1933 | Barcalo . | |
| D. 91,262 | 1/1934 | Barcalo . | |
| 98,859 | 1/1870 | Fast . | |
| D. 118,319 | 12/1939 | Kandell . | |
| D. 168,139 | 11/1952 | Brady . | |
| D. 211,721 | 7/1968 | Radford . | |
| D. 256,535 | 8/1980 | Martin . | |
| D. 289,354 | 4/1987 | Willey . | |
| 1,890,358 | 12/1932 | Barcalo . | |
| 1,934,254 | 11/1933 | Barcalo . | |
| 2,314,080 | 3/1943 | Dine et al. . | |
| 2,351,849 | 6/1944 | Wells et al. . | |
| 2,877,472 | 3/1959 | Wagner . | |
| 2,940,087 | 6/1960 | Kiefer | 5/436 |
| 3,284,817 | 11/1966 | Landwirth . | |
| 3,411,164 | 11/1968 | Sumergrade | 5/441 |
| 3,938,205 | 2/1976 | Spann . | |
| 4,142,263 | 3/1979 | Pierson . | |
| 4,171,549 | 10/1979 | Morrell et al. . | |
| 4,928,806 | 10/1933 | Barcalo . | |

FOREIGN PATENT DOCUMENTS

| | | |
|---|---|---|
| 778039 | 2/1968 | Canada . |
| 455914 | 8/1913 | France . |
| 491261 | 8/1938 | United Kingdom . |

OTHER PUBLICATIONS

Peoples Home Health Care Catalog, "Wal-Pil-O Cervical Pillow", Mar. 1983, vol. 3-83.

*Primary Examiner*—Richard J. Apley
*Assistant Examiner*—Susan L. Weinhoffer
*Attorney, Agent, or Firm*—Wells, St. John & Roberts

[57] ABSTRACT

An inflatabled leg-supporting bolster includes a pair of flexible side panels joined to opposite side edges of a connecting flexible sheet that encircle them. A horizontal web and a plurality of upright webs are provided at the interior of the bolster to define lateral and upright configurations required for proper leg support when used by a person lying in a supine position.

6 Claims, 3 Drawing Sheets

INFLATABLE LEG-SUPPORTING BOLSTER

TECHNICAL FIELD

This disclosure pertains to leg-supporting bolsters for persons lying in a supine position on a horizontal surface. Such bolsters are well known as therapeutic devices to relieve lower back pain.

BACKGROUND OF THE INVENTION

Solid bolsters cut from resilient foam have been used for many years to assist in relieving lower back pain. Such bolsters are available in a variety of shapes and sizes. They are typically sold as generic products in foam shops. Such bolsters have solid trapezoidal configuration that includes upwardly-inclined surface areas exposed across the top of the bolster and intersecting one another at a right angle. One of these areas intersects the base of the bolster at an acute angle and obtuse for engagement by the legs.

One difficulty with foam bolsters is the inherent bulk of material required to support the legs of a user. Such bolsters cannot be easily carried or shipped from one location to another. In addition, the foam material must be relatively stiff in order to provide the required support for the weight of the user's legs. The foam material will not be compressed uniformly about the leg surfaces engaging the bolster, which eventually interferes with circulation of blood through the legs during its use. In addition, foam bolsters must be provided in several sizes so as to meet the dimensional requirements of various users.

Another prior product designed for such leg support is known as the "Waverly Wedge." It comprises a planar inflatable member having transverse tubes and bendable along a transverse line to form inclined areas defined by tension straps extending between the respective ends of the device. This structure requires rather substantial interior air pressure in order to be self-supporting over the spaced straps. It lacks lateral stability and, if not properly inflated, will not attain the proper upright configuration for use as a leg support.

The present invention was designed to provide a portable bolster that can be readily packed in luggage for travel purposes and which does not require substantial storage or closet space in the home when it is not in use. As a result of this development effort, it was discovered that the inflatable product could be adapted to the dimensional needs of a wide range of people, while maintaining both upright and lateral stability for support purposes. This stability is provided by a unique combination of horizontal and upright ribbing members within the bolster.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The drawings illustrate the inflated condition of the present bolster. Its inflatable nature enables it to be configured for use by introduction of air, using the light-duty pump or one's mouth. The bolster can be readily deflated when not in use, and will store in a relatively small space for travel or storage purposes.

The bolster comprises a pair of flexible side panels 10. Each of the side panels 10 has an identical shape. The boundary of each side panel 10 includes a plurality of intersecting edges that define the longitudinal cross-sectional exterior shape of the inflated bolster. As shown, the side panels 10 have four intersecting edges arranged about their respective peripheries in a trapezoidal configuration.

Figure 1:
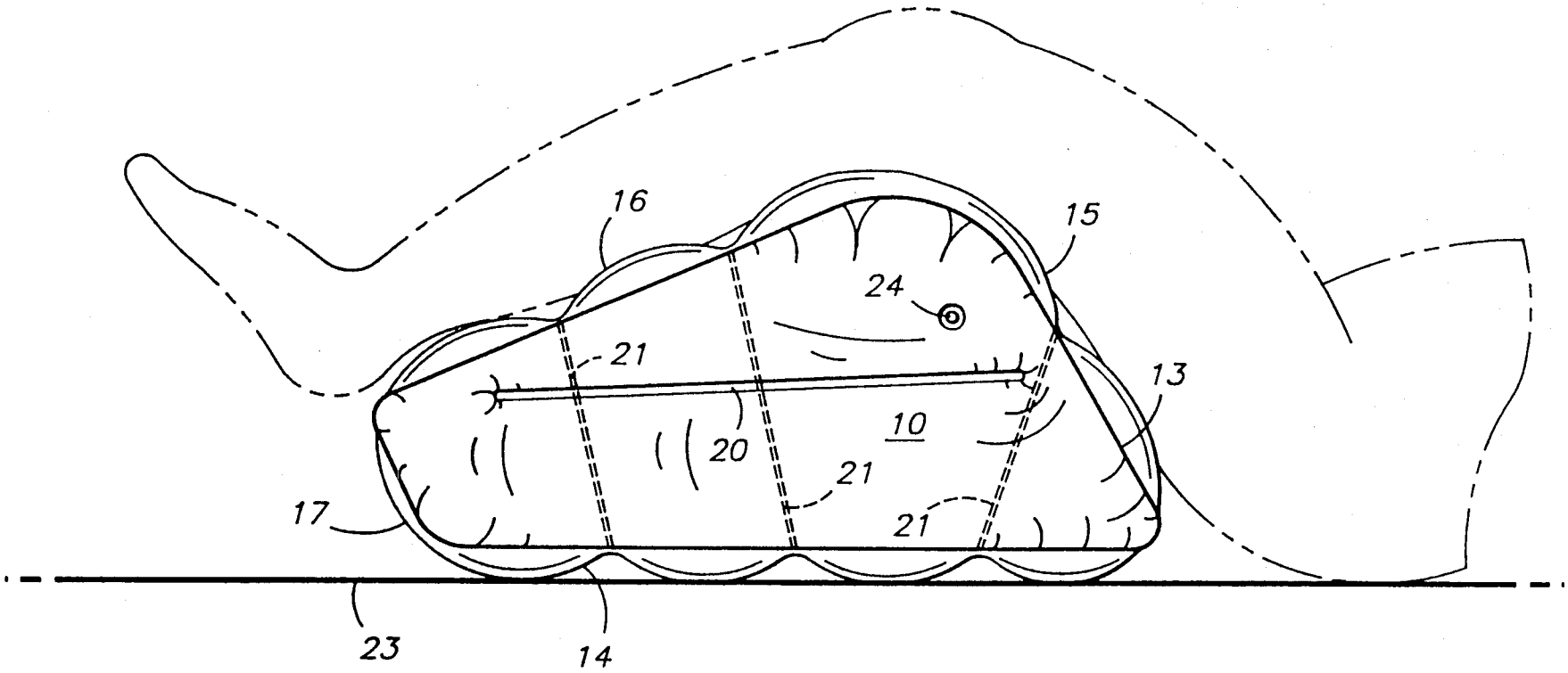
FIG. 1 is a side elevation view of the inflated bolster, the outline of a user's legs being illustrated in dashed lines.
Figure 5:
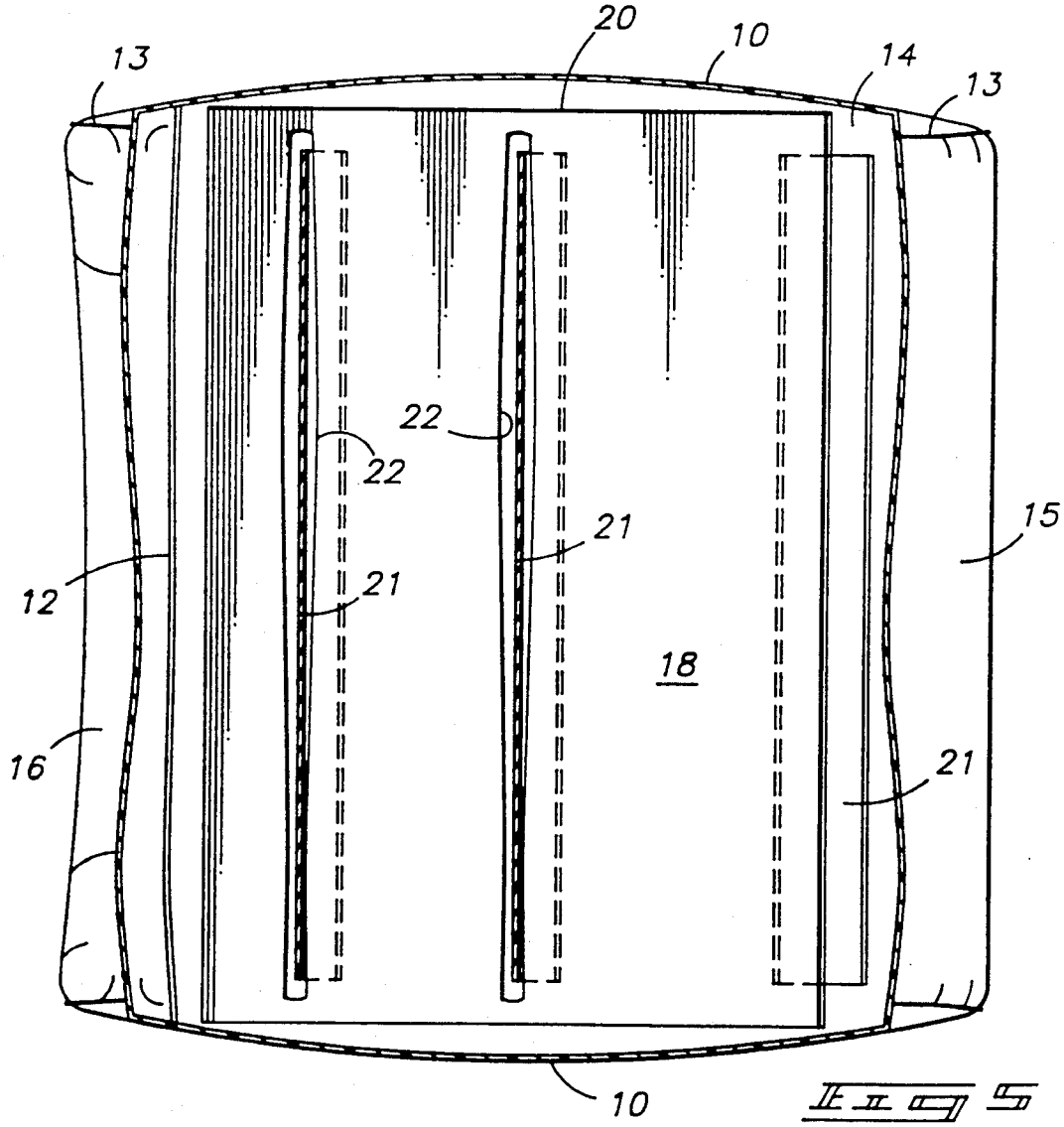
FIG. 5 is a horizontal sectional view taken along line 5—5 in FIG. 2.

The bolster is completed by a flexible sheet 11. The sheet 11 has laterally-spaced parallel side edges extending between transverse end edges. Sheet 11 is sealed to its self across its end edges along a transverse seam 12 (FIG. 5). It is also sealed to the edges of the side panels along its respective side edges to form a peripheral seam 13 about each side of the bolster. The seams 13 complete a sealed inflatable structure for the bolster by forming a circumferential support extending between the side panels 10. This circumferential support presented by sheet 11 includes a bottom base area 14, and two upwardly-inclined areas 15 and 16. The areas 15 and 16 intersect one another at an upper apex. The angle of intersection between them is a right angle. The angle of intersection between area 15 and the base area 14 is an angle greater than 45 degrees (preferably 65°), while the angle between the area 16 and base area 14 is an angle less than 45 degrees (preferably 25°). In the preferred form of this invention, there is also provided a relieved section 17 along the sheet 11, which serves to suspend the feet of a user elevationally above a supporting surface for the bolster, as indicated in FIG. 1.

Figure 2:
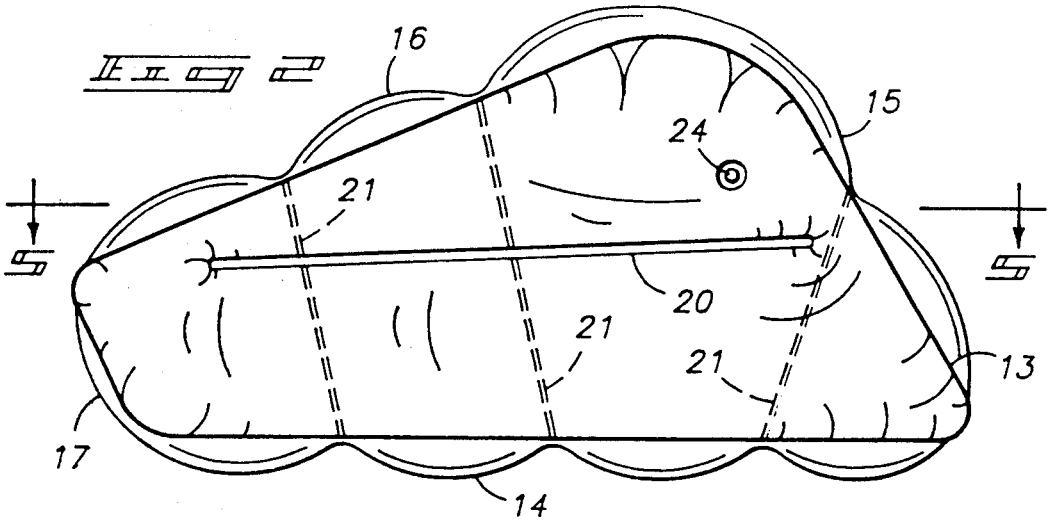
FIG. 2 is a side elevation view of the bolster alone.
Figure 3:
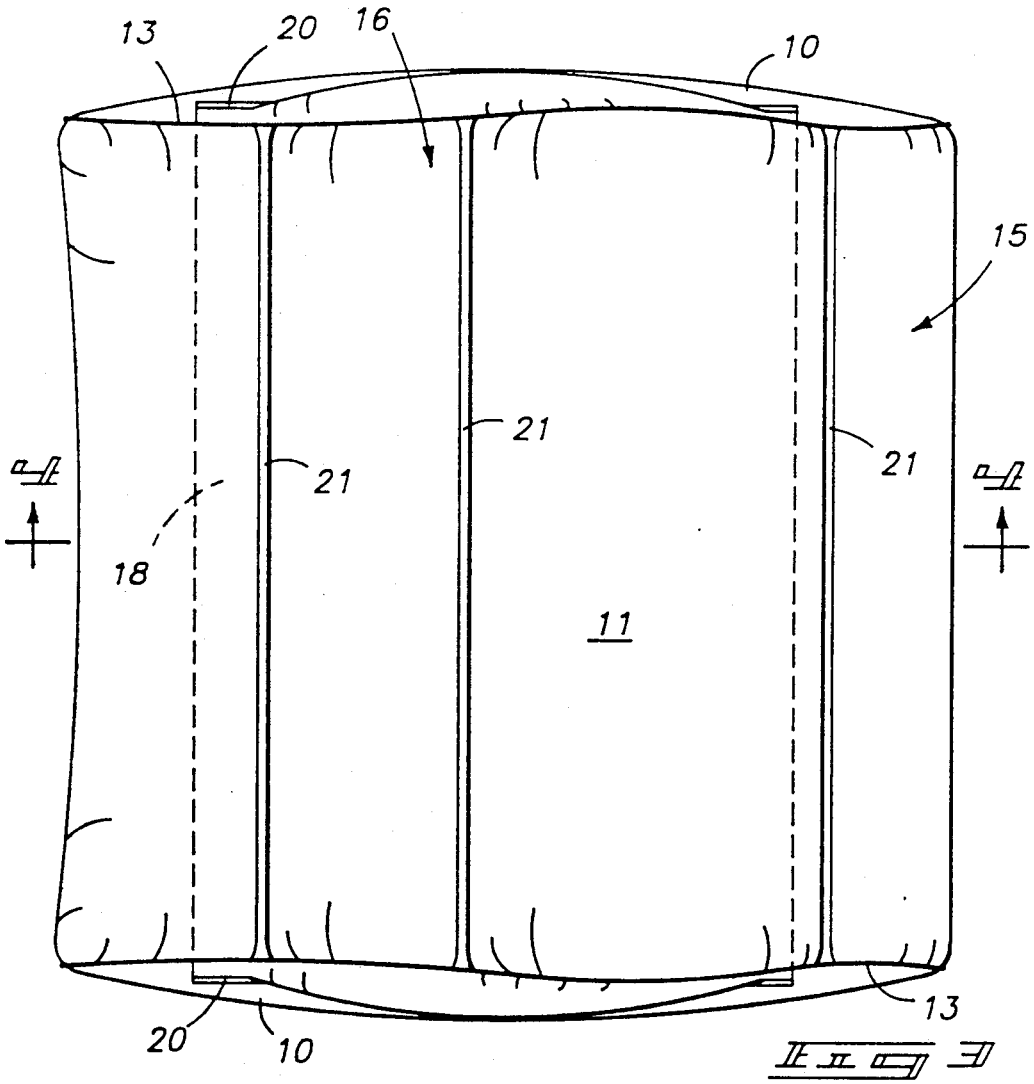
FIG. 3 is a plan view.
Figure 4:
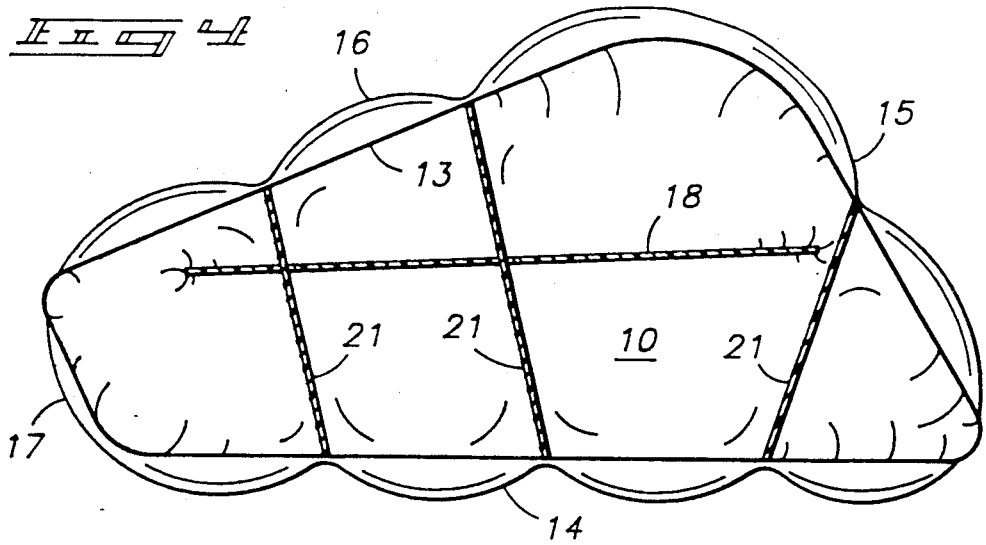
FIG. 4 is a longitudinal sectional view taken along line 4—4 in FIG. 3.

Horizontal ribbing means is joined across the side panels 10 for defining their lateral separation when the bolster is inflated. The horizontal ribbing means is illustrated as a rectangular flexible web 18. Web 18 has opposed transverse ends fixed to the respective side walls 10 along seams shown at 20. The seam 20 between the transverse ends of web 18 and side walls 10 are positioned at locations spaced from the seams joining the side walls 10 and the base area 14 of sheet 10. Web 18 extends across the full inner widths of the side walls 10 between the seams joining the side walls 10 and the upwardly-inclined areas 15, 16 of sheet 10. As can be seen in FIGS. 2 and 4, the elevation of web 18 is approximately half that of the elevation of the apex formed between the sheet 11 and the supporting side walls 10.

The upright ribbing means is illustrated as a plurality of flexible webs 21. Each web 21 has a lower end and an upper end fixed respectively across the full inner width of the base area 14 and one of the upwardly-inclined areas 15, 16 of sheet 10. Horizontal web 18 is slitted, as shown at 22, to freely surround the individual upright webs 21. There is no structural connection between the webs 18 and 21 in the illustrated embodiment, although such connections can be provided if desired.

The upright webs 21 are joined to the base area 14 of sheet 10 across longitudinal parallel seams which are spaced at approximately equal distances along the bottom of the bolster. This equal spacing helps to assure the presentation of co-planar surfaces across the bottom of the bolster, which are adapted to rest on an upwardly-facing horizontal support surface indicated by line 23 in FIG. 1. Similarly, the longer of the two upwardly-inclined areas 16 is intersected by two or more upright webs 21. They also are located at equal distances along the length of area 16. The resulting transverse ribs in the inflated structure will therefore present coplanar surface areas for engagement by the legs of a user. The single upright web 21 extending to the upwardly-inclined area 15 of sheet 10 intersects it substantially at its midpoint, also providing coplanar surfaces along the resulting ribs in the inflated structure.

A conventional air valve 24 can be provided at any suitable location about the bolster. Air can be delivered to the bolster by a pump or by manual blowing. Air valve 24 can be released to deflate the bolster prior to folding it for storage or travel purposes.

Besides portability and light weight, the inflated bolster has the advantage of being adjustable to accommodate a reasonable range of body sizes. By directing more or less air to the interior of the bolster, one can make it somewhat smaller or larger to fit the size of a particular user. In a bolster having a height of approximately 9", a variable size range of approximately 2" is practical by control of inflation pressure.

The inflated bolster is designed to be used by one resting on a mattress or floor in a supine position. The bolster relieves the normal stress applied to the lower back area and helps to maintain flexibility and relieve localized pain in the lower areas of the spine. The bolster is also useful to provide support for the legs of a woman in the later stages of pregnancy. It promotes circulation, provides back support and elevates the legs. Foam bolsters are not acceptable for this purpose because they are typically too rigid and tend to interfere with circulation of blood in the legs.

While designed particularly for the use shown in FIG. 1, the present bolster can also be used as a back rest cushion. When so used, the short side of the bolster presented by upwardly inclined area 15 serves as the bottom surface and the base area 14 serves as an inclined back rest when the bolster is positioned with its area 16 against a vertical wall or furniture surface.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An inflatable leg-supporting bolster adapted to rest upon a surface for engagement by and support of the legs of a person lying in a supine position on the surface, comprising:

a pair of flexible side panels, each side panel having an identical shape including a plurality of intersecting edges arranged about its periphery;

a flexible sheet having laterally-spaced parallel side edges extending between transverse end edges, the sheet being sealed to itself across its end edges and being sealed to the edges of the side panels along its respective side edges to complete a sealed inflatable structure by forming a circumferential support extending between the side panels, the circumferential support including a base area and two upwardly-inclined areas that intersect one another;

horizontal ribbing means joined across the side panels for defining their lateral separation when the bolster is inflated;

upright ribbing means joined between the base and each of the upwardly-inclined areas of the sheet for defining their vertical separations when the bolster is inflated; and air valve means for selectively admitting or releasing air within the bolster;

whereby the bolster, when inflated, can rest upon a surface while supported by the base area and with the side panels in spaced parallel positions holding the sheet in a configuration exposing the upwardly-inclined areas of the sheet for engagement by the legs of a supine user.

2. The bolster of claim 1, where the upright ribbing means comprises:

a plurality of flexible webs, each web having a lower end and an upper end fixed respectively to the base area and one upwardly-inclined area of the sheet.

3. The bolster of claim 1, where the upright ribbing means comprises:

a plurality of flexible webs, each web having a lower end and an upper end fixed respectively across the full inner widths of the base area and one upwardly-inclined area of the sheet.

4. The bolster of claim 1, where the horizontal ribbing means comprises:

a flexible web having transverse ends fixed to the respective side walls at locations spaced from the seams joining the side walls and the base area of the sheet.

5. The bolster of claim 1, where the horizontal ribbing means comprises:

a flexible web having transverse ends fixed to the respective side walls at locations spaced from the seams joining the side walls and the base area of the sheet and extending parallel to the base area across the full inner widths of the side walls between the seams joining the side walls and the upwardly-inclined areas of the sheet.

6. An inflatable leg-supporting bolster adapted to rest upon a surface for engagement by and support of the legs of a person lying in a supine position on the surface, comprising:

a pair of flexible side panels, each side panel having an identical shape including four intersecting edges arranged about its periphery;

a flexible sheet having laterally-spaced parallel side edges extending between transverse end edges, the sheet being sealed to itself across its end edges and being sealed to the edges of the side panels along its respective side edges to complete a sealed inflatable structure by forming a circumferential support extending between the side panels, the circumferential support including a base area, two upwardly-inclined areas that intersect one another, and a relieved section interposed between the base and one of the upwardly-inclined areas;

horizontal ribbing means joined across the side panels for defining their lateral separation when the bolster is inflated;

upright ribbing means joined between the base and each of the upwardly-inclined areas of the sheet for defining their vertical separations when the bolster is inflated; and air valve means for selectively admitting or releasing air within the bolster;

whereby the bolster, when inflated, can rest upon a surface while supported by the base area and with the side panels in spaced parallel positions exposing the upwardly-inclined areas of the sheet for engagement by the legs of a supine user.

* * * * *